United States Patent [19]

Yamada

[11] Patent Number: 4,858,908

[45] Date of Patent: Aug. 22, 1989

[54] SHEET TRANSPORTING SPEED CONTROL APPARATUS

[75] Inventor: Hirokazu Yamada, Osaka, Japan

[73] Assignee: Minolta Camera Kabushiki Kaisha, Osaka, Japan

[21] Appl. No.: 236,940

[22] Filed: Aug. 26, 1988

[30] Foreign Application Priority Data

Aug. 28, 1987 [JP] Japan ..... 62-216113

[51] Int. Cl.[4] ..... B65H 43/08

[52] U.S. Cl. ..... 271/176; 271/202; 271/265

[58] Field of Search ..... 271/176, 202, 203, 259, 271/263, 265

[56] References Cited

U.S. PATENT DOCUMENTS

| | | | |
|---|---|---|---|
| 3,794,417 | 2/1974 | Machmer . | |
| 3,988,018 | 10/1976 | Tusso | 271/202 X |
| 4,548,403 | 10/1985 | Matsui et al. | 271/296 |
| 4,676,499 | 6/1987 | Kimizuka | 271/202 X |
| 4,745,435 | 5/1988 | Sakata et al. | 355/145 H |

*Primary Examiner*—Richard A. Schacher

*Attorney, Agent, or Firm*—Burns, Doane, Swecker & Mathis

[57] ABSTRACT

An apparatus for controlling a transporting speed of a second transporting mechanism which is connected to a first transporting mechanism equipped with a speed sensor for detecting transporting speed of the second mechanism and a position sensor for detecting a position of a sheet being transported by the first and second transporting mechanisms. The second transporting mechanism is controlled by a first control for maintaining a predetermined speed basing on the information of the speed sensor when a sheet is not in both the first and second mechanisms which is detected by the position sensor, and when a sheet is in both the first and second sensor, receives the second control based on the control of memory contents in the first control. The first control is arranged to control a revolution speed of a driving motor by converting the time when the driving motor in the second mechanism is turned on and off, while the second control is arranged to control the second transporting mechanism for lowering a speed under a predetermined speed when a transporting speed of the second transporting mechanism exceeded the predetermined speed.

9 Claims, 6 Drawing Sheets

SHEET TRANSPORTING SPEED CONTROL APPARATUS

BACKGROUND OF THE INVENTION

1. Technical Field of the Invention

The present invention relates to a sheet transporting speed control apparatus and more particularly to a sheet transporting speed control apparatus preferably applicable to a control system when a document to be transported is delivered in the transporting systems which are controlled in constant speed by a plurality of independent control systems.

2. Brief Description of the Prior Art

In a copying machine including an image processor and a sorter, for instance, when the sorter receives a paper discharged from the image processor, a transporting speed of the sorter is arranged to be faster than that of the image processor because it is difficult to completely match the speeds with each other and paper jam is feared when the speed of the sorter is delayed since they are controlled by different control systems.

At the time when a paper is transported from an image processor to a sorter, if a state of pulling each other is generated, the sorter tends to carry the paper in full power in order to correct the lowered speed since the speed of sorter is set faster than that of the image processor, whereby the paper is torn and causes backlash and chipping of gear in the image processor to result in bad influence on an image.

In order to prevent such problems, the device has heretofore been arranged to increase restraint to a pulling torque by a mechanical structure providing with a mechanism such as sliding clutch in a drive transmission section in the sorter. However, the cost becomes too expensive since such mechanical structure is so complicated, and especially, there remain problems in the functional stability of a sliding clutch.

SUMMARY OF THE INVENTION

The main object of the present invention is to provide an inexpensive paper transporting speed control apparatus capable of stably absorbing the speed difference in the transporting system.

Further object of the present invention is to provide an inexpensive paper transporting speed control apparatus capable of avoiding an abnormally high speed by electrically controlling the transporting speed not to exceed a predetermined maximum speed. The speed may be simply adjusted to correspond with that of the other transporting system by increasing restraint to a torque wherein constant voltage control, constant current control, etc. are performed basing on the past data stored in a memory means of a second control means in place of a constant speed control by a first control means while a document to be transported is held in between the other transporting system. As it is difficult to accurately detect the conditions when a document to be transported is held in both of the transporting system, the device is designed to convert the transporting system to under the control of the second control means before the document gets into the transporting system, while the second control means is returned to under constant speed control by the first control system after the document to be transported is left the other transporting means.

The other objects and features of the present invention will become more apparent from the following description taken in conjunction with the accompanying drawings which illustrate specific embodiments of the invention.

DETAILED DESCRIPTION OF THE INVENTION

Embodiments of the present invention applied to a sheet transporting mechanism of a sorter connected with a copying machine will be described below.

Figure 1:
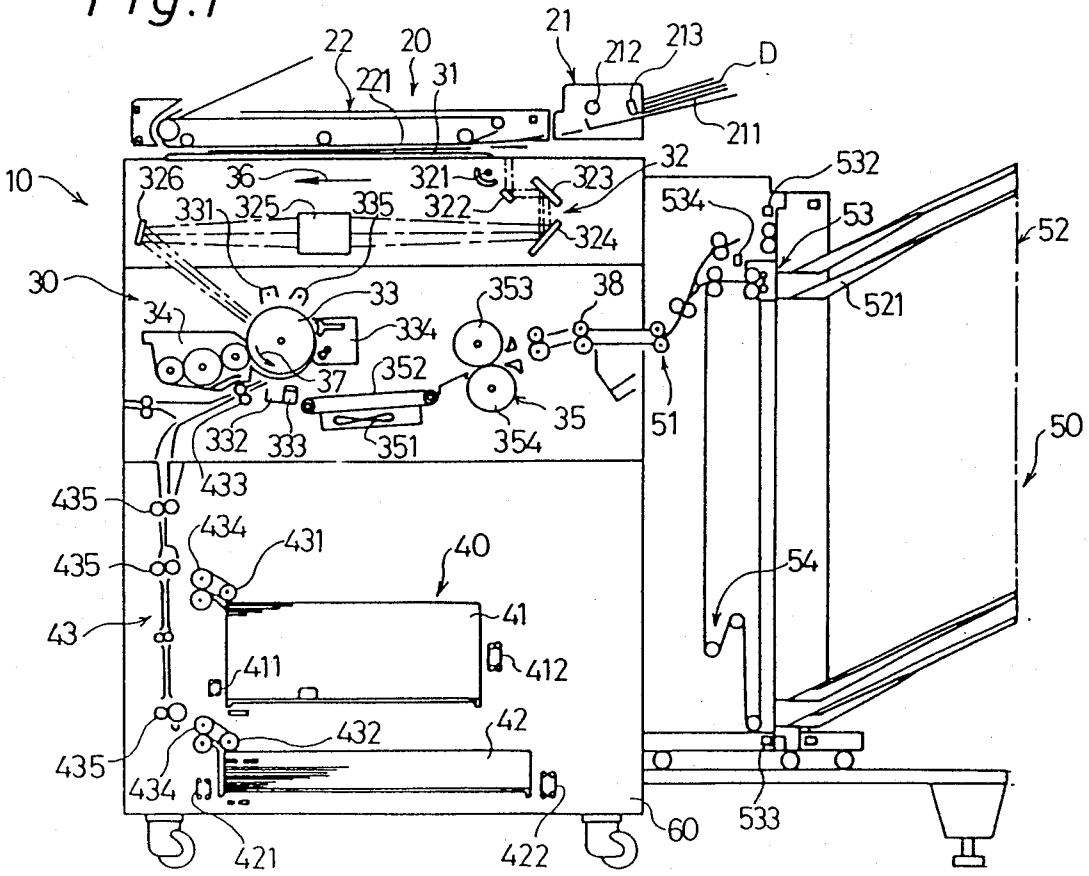
FIG. 1 is a schematic view illustrating the whole structure of a copying machine to which the present invention is applied.

FIG. 1 shows the whole structure of a copying machine and a sorter.

The main body 10 of a copying machine illustrated in this embodiment is equipped with an automatic document feeding device 20 (hereinafter briefly marked as ADF20) disposed on a document support glass table of the main body 10 onto which a document D to be copied is automatically supplied one by one so that the function of the copying machine is further improved. And, at the right hand side of FIG. 1, a sorter 50 is equipped for sorting the sheets of paper discharged from the main body of the copying machine.

An image forming section 30 of the main body of copying machine 10 is comprised of an exposure optical system 32 for scanning the surface of a document D to be copied which is placed on a document support glass table 31, a photosensitive drum 33 on which an electrostatic latent image is formed by an image exposure by the exposure optical system 32, a developing device 34 for forming the electrostatic latent image into toner image and a fixing device 35 for fixing after the toner image is transferred onto a sheet of paper.

The exposure optical system 32 is arranged for scanning in the direction of arrow 36 under the document support glass table 31, and is mainly comprised of an exposure lamp 321, movable mirrors 322, 323, 324, a projection lens 325 and a fixed mirror 326. The exposure lamp 321 and movable mirrors 322 move coincidently with each other in the direction of arrow 36 at a speed of (V/m) against the peripheral speed (V) of the photosensitive drum 33, and the movable mirrors 323, 324 move coincidently with each other in the direction of arrow 36 at a speed of (V/2m).

The photosensitive drum 33 is movable counterclockwise in the direction of arrow 37. Around the photosensitive drum 33, a charger 331, a developing device 34, a transfer charger 332, a separation charger 333, a cleaning device 334 and an eraser lamp 335 are disposed sequentially in the rotating direction of the photosensitive drum 33. The photosensitive drum 33 is uniformly charged by the charger 331 with its rotating movement in the direction of arrow 37 and an electrostatic latent image is formed thereon by an image exposure of the exposure optical system 32. The electrostatic image formed on the photosensitive drum 33 is then developed by the developing device 34 thereby visualizing an image.

The fixing device 35 is mainly comprised of a heat roller 353 for fixing unfixed toner image onto a sheet transported via conveyor belt 352 which is provided with an air suction means 351 and a fixing roller 354. The sheet conveyed from the fixing device 35 is discharged onto a bin of sorter 50 from a discharge roller 38 which will be described later. The transporting speed of the sheet being carried by the discharge roller 38 is kept constant.

A sheet accommodating section 40 is comprised of elevator type sheet accommodating sections 41 and 42. They are arranged to freely pull out forward by rails 411, 412, 421 and 422.

The sheet feeding means 43 is mainly comprised of the first sheet feeding rollers 431 for transporting the sheets accomodated in the sheet accommodating section 41, the second sheet feeding rollers 432 for transporting the sheets accomodated in the sheet accommodating section 42, 4 pieces of disposal rollers 434 disposed successively behind each one of the sheet feeding a rollers 431, 432 for selectively conveying the sheets one by one to register rollers 433 and transporting rollers 435 disposed successively behind the disposal rollers 434 for conveying the sheets to the register rollers 433.

The sheet fed to the position of register rollers 433 is temporarily stopped thereat until it is driven for conveyance, and then the sheet is forwarded to the transfer section simultaneously with the image formed on the photosensitive drum 33. Thereafter, the toner image on the photosensitive drum 33 is transferred by electric discharge of the transfer charger 332 and the image is separated from the surface of the photosensitive drum 33 by electric discharge of the separation charger 333. The separated sheet is then carried to a fixing section 35 by a conveyor belt 352 provided with an air suction means 351, and a toner image receives fusion fixing procedure. On the other hand, the toner remained on the photosensitive drum 33 is removed by a cleaning device 334 and the residual charge is removed by irradiation of eraser lamp 335 ready for next copying operation.

ADF 20 is a device held with documents D stacked therein and is arranged to successively feed the documents D onto the document support glass table 31. The ADF 20 is composed of a document D receiving table 211, a paper feeding rollers 212 for feeding the documents on the receiving table 211 one by one to the document support glass table, a driving motor (not shown) for driving the paper feeding rollers 212 and a detecting unit 213 for detecting as to whether or not documents are on the receiving table 211. 22. The document transporting section 22 is mainly comprised of a conveyor belt device 221 and a driving motor (not shown).

Figure 2:
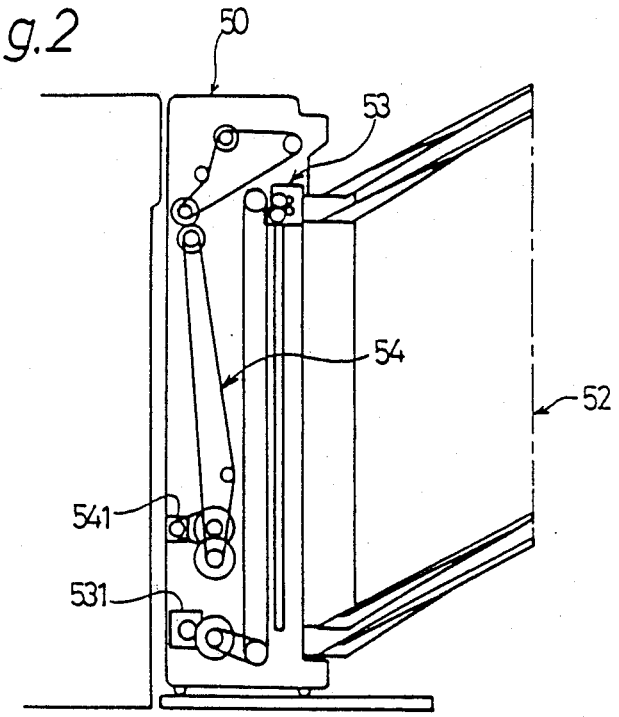
FIG. 2 is a structural view showing a driving mechanism of a sorter.

A sorter 50 is mainly comprised of a receiving section 51, a bin assembly 52 provided with a plurality of bins 521, a gate section 53 vertically movable along the bin assembly 52 and a transporting section 54 including an ordinary belt and an endless belt. The gate section 53, as illustrated in FIG. 2, is arranged to be driven by a gate motor 531 and the transporting section 54 by a transporting motor 541.

At a delivery section of the gate section 53, light transmission type discharge sensors 532, 533 are disposed and is arranged to detect the sheets being discharged. A home position sensor 534 is arranged to detect that the gate section 53 is at the uppermost position and is set as a basic position when it is driven by the gate motor. The transporting section 54 includes a motor pulse generating section (not shown) for generating pulse of frequency corresponding to the revolution speed of the transporting motor 541, i.e. the transporting speed of sheet, and the motor pulse is inputted into a microcomputer which controls sorter 50, and controls driving of the transporting section 54. The sheet transporting speed of the transporting section 54 is predetermined at a value faster than that of the discharge rollers 38.

The sheet discharged from the discharge rollers 38 in the main body of the copying machine is received by the sheet receiving section 51 and is forwarded to a bin 521 via the transporting section 54 and gate section 53. The sheet is detected by sensors 532,533 disposed at the portion of the gate section 53, and when it is confirmed that the sheet is completely carried away, the gate section 53 moves to the next bin 521 to face its inlet and the sheet transported thereto is forwarded to the next bin 521. The sheets are successively distributed to the next bin 521 in the manner described above, and upon completion of the distribution, the gate section 53 returns to the starting position facing to the bin 521 positioned uppermost and wait for distribution of copying paper for next document.

Figure 3:
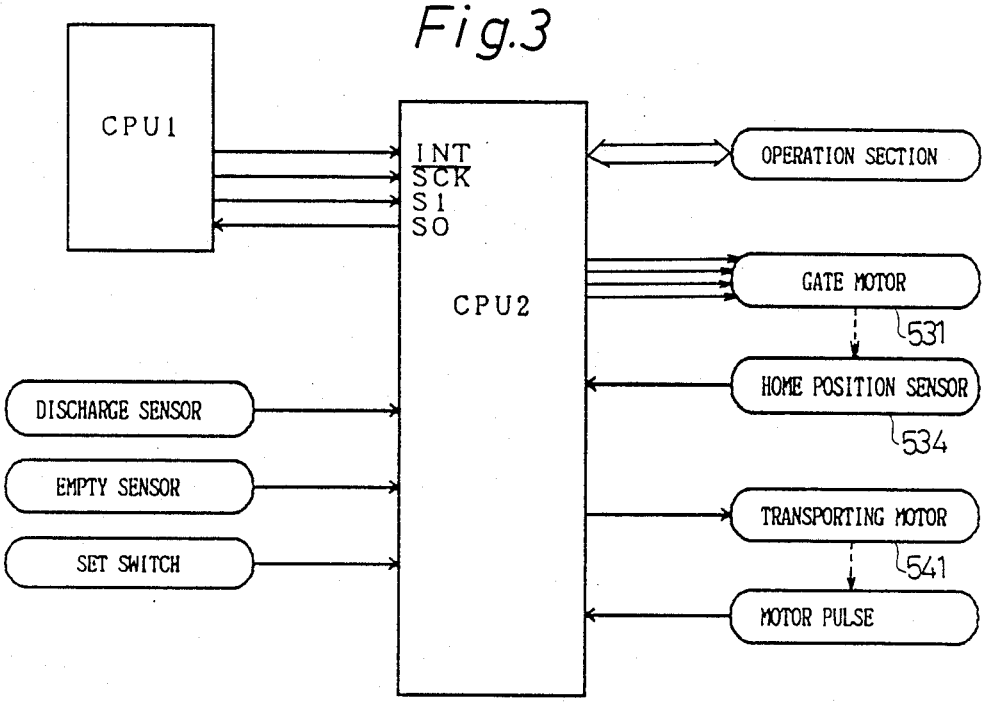
FIG. 3 is a block diagram showing a control circuit of a sorter.

A structural view of microcomputer control is shown in FIG. 3. CPU 1 controls the main body 10 of a copying machine and performs input from various sensor switches, output to motor, clutch and input/output from/to operation section (omitted in the figure) while making communication and information exchange with CPU 2 by serial signal.

CPU 2 controls the sorter 50. The CPU2 performs input from home position sensor 534, discharge sensor, empty sensor, set switch, output to the gate motor 531 and transporting motor 541, and input/output from/to operation section while making communication with the CPU 1 by serial signal. Counter, timer, memory 1,2 which will be described later with relative flow chart are stored in the CPU 2.

Figure 4:
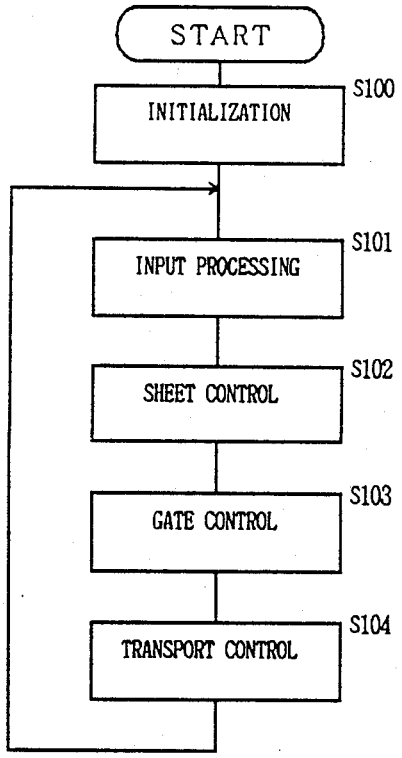
FIG. 4 is a flow chart illustrating a main routine of a program for an operation control of a copying machine.

Control by sorter 50 will now be described referring to the flow chart illustrated in FIGS. 4 through 7. FIG. 4 is a flow chart showing a main routine. At step S100 in the flow, initialization is performed for input/output port, memories and registers, etc. Then, at S101, input from input port is performed and data is stored in memory bank, and mode setting procedure for sorter 50 is also performed at the same time. At S102, the conditions of paper in transit and in the bin 521 are checked and proper procedure corresponding to each condition is performed. Next, at step S103, control is done for moving the gate section 53 to the discharging position corresponding to the mode of sorter. Finally at step S104, control is made on the transporting motor 541 of the sorter 50, and then the step returns to S101.

Figure 5:
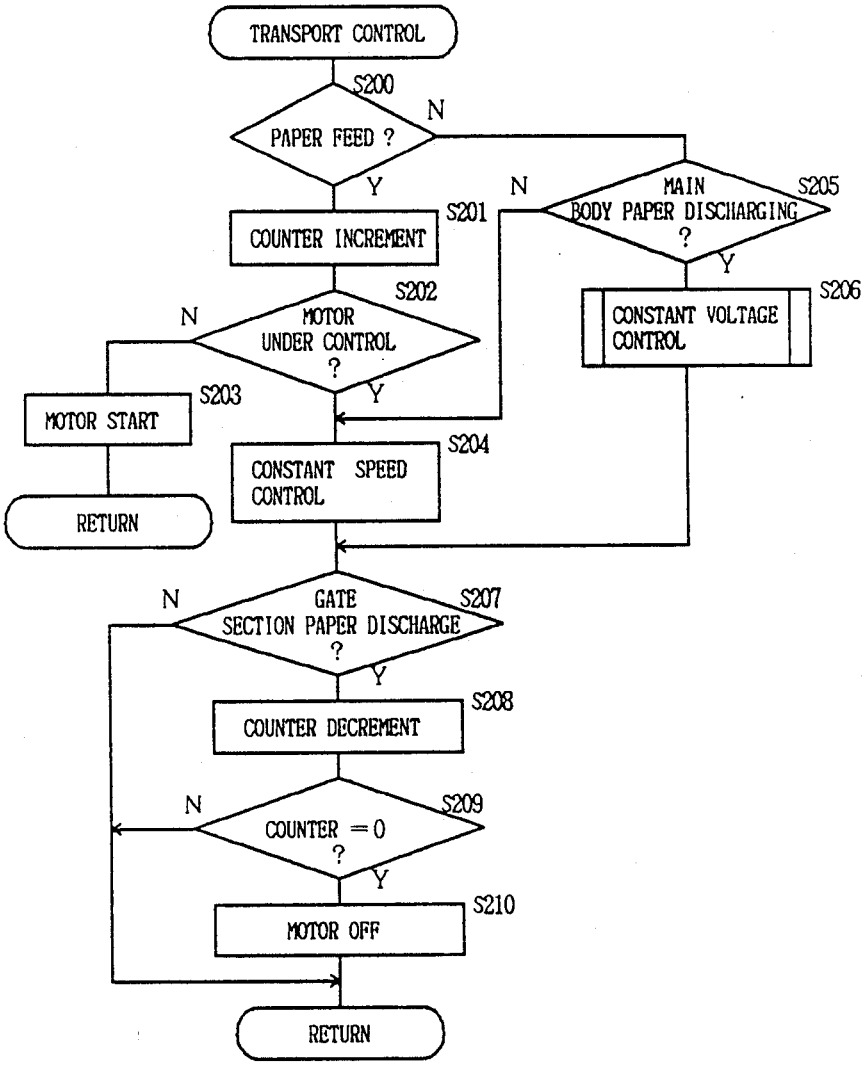
FIG. 5 is a flow chart showing a subroutine of the transporting control in FIG. 4.

The step S104 will be described more in detail with reference to FIGS. 5 through 7. FIG. 5 is a flow chart illustrating the transporting control subroutine for controlling the transporting motor 541 in the main routine S104. At step S200 in the flow, check is made as to whether paper feeding is performed or not in the main body 10 of the copying machine, and when paper feeding has been made, counter increment is executed at S201, and the step moves to S202. The counter is provided for controlling the number of sheets being transported, and increment is made for paper feeding and decrement is made when the sorter discharged a paper. At S202, check is made as to whether the transporting motor 541 is under control or not, and if the motor is not under control, the transporting motor 541 and a timer to be used for control, which will be described later, are started at step S203. Thereafter, the step returns to main routine. When the motor 541 is under control or the paper is not being discharged from the main body 10 of the copying machine at step S205, constant speed control for transporting motor 541 is performed at step S204.

If the paper is being discharged from the main body 10 of the copying machine, constant voltage control is performed at S206 since the paper is extending over both the discharge rollers 38 in the main body 10 of the copying machine and the transporting section 54 of the sorter 50. At S207, check is made as to whether a paper is discharged from the gate section 53 or not. When a paper is not discharged, the step returns to main routine and if a paper has been discharged, counter decrement is made at S208, then proceeds to step S209. At S209, check is made as to whether counter became 0 or not wherein 0 means where is no sheet left in transit, and the transporting motor 541 and timer are turned off at S210, and the step returns to main routine.

Figure 6:
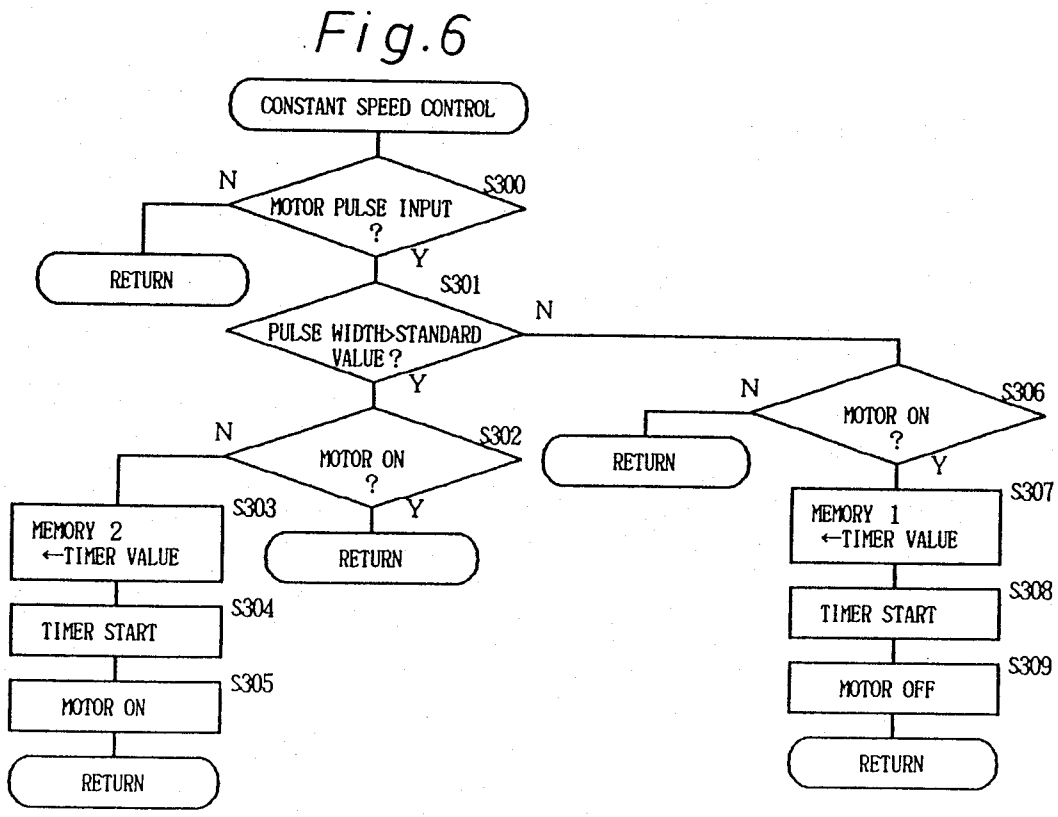
FIG. 6 is a flow chart showing a subroutine of the constant speed, control in FIG. 5.

FIG. 6 is a flow chart illustrating a subroutine of constant speed control for the transporting motor 541 shown in step S204 of FIG. 5. At step S300 in the flow, check is made as to whether motor pulse is inputted or not. When input is not made, the step returns to the routine in FIG. 5. When motor pulse is inputted, the pulse width corresponding to frequency is measured by hardware in the CPU 2 and is stored in the register. Then, the pulse width is compared with a standard value set for constant speed control at step 301. When the pulse width is longer, the step proceeds to S302, and if the pulse width is not longer, the step proceeds to S306 respectively, and thereafter check is made as to whether each one of the transporting motor 541 is turned on or not. At S302, when the transporting motor is turned on, the step returns to the routine in FIG. 5. If the transporting motor is turned off, the step proceeds to S303–S305. At this stage, the timer value is stored in memory 2 and the motor is started again after timer value is set again. Thereafter, the transporting motor is turned on and the step returns to the routine in FIG. 5. When the transporting motor is turned off at the S306, the step returns to the routine in FIG. 5, and if the motor is turned on, the step proceeds to S307–S309. At this stage, the timer value is stored in memory 1 and the timer starts again after it is reset, thence transport motor is turned off. The timer at this stage functions for measuring the time when motor is turned on or turned off under constant speed control, and the measured on or off time is stored in both memory 1 or memory 2 and control is performed corresponding to the contents of memory at the time of constant voltage control, which will be described later.

Figure 7:
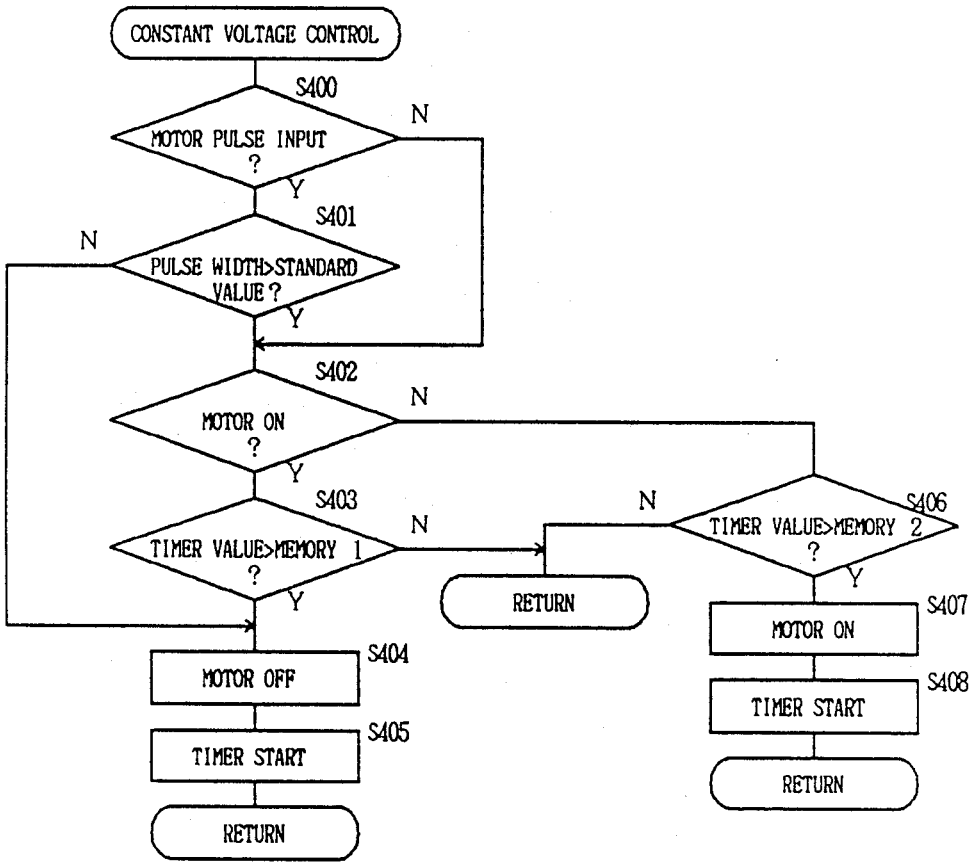
FIG. 7 is a flow chart showing a subroutine of the constant voltage control in FIG. 5.

FIG. 7 is a flow chart showing a subroutine of the constant voltage control for the transport motor at step S206 in FIG. 5. At step S400 in this flow, check is made as to whether motor pulse is inputted or not. When it is not inputted, the step proceeds to S402, and if it is inputted, the step proceeds to S401 and pulse width is compared with the standard value. If the pulse width is longer, the step proceeds to S402, and if it is not longer, the step moves to S404 and transport motor is turned off instantly, then timer is started at step S405. Accordingly, even if a sheet is come off the discharge roller 38 in the main body 10 of the copying machine and is being transported only by the transport section 54 of the sorter 50, abnormal increase in speed can be prevented.

At step 402, check is made as to whether the transport motor is turned on or not. When it is on, the step proceeds to S403, and if it is off, the step moves to S406, and thereafter comparison is made between the timer value and the data of memory 1 or memory 2. If the timer value exceeds the data, the step proceeds to S404,S405 or S407,S408, and the transport motor is either turned on or turned off, then the timer is started again. Thereafter, the steps return to the routine in FIG. 5. The timer at this stage functions for controlling the time when the transport motor is turned on or turned off under constant voltage control, and its duty is determined according to the data in memory 1 and memory 2. Thus, abnormal rise in the transport torque can be prevented by carrying on the constant voltage control corresponding to the information on the transport motor control under the state of constant speed control.

In the embodiments, description has been made on the changing over of the constant speed control and constant voltage control. However, constant current control, i.e. constant torque control, may be applied in place of the constant voltage control.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sheet transporting apparatus, comprising:

a first transporting means;

a second transporting means for receiving sheets transported by the first transporting means and conveying the sheets to the same direction, transporting speed of the second transporting means is higher than that of the first transporting means;

a first detecting means for detecting the transporting speed of the second transporting means;

a first control means for controlling the second transporting means in according to said first detecting means;

memory means for storing the contents of control by the first control means;

a second control means for controlling the second transporting means basing on the contents stored in the memory means;

a second detecting means for detecting the position of sheet being transported; and a third control means for selecting either one of the first control means or the second control means according to said second detecting means.

2. A sheet transporting apparatus as defined in claim 1, wherein the first control means controls transporting speed of the second transporting means to become constant.

3. A sheet transporting apparatus as defined in claim 1, wherein the second transporting means includes a driving motor, and the first control means controls revolution of the driving motor.

4. A sheet transporting apparatus as defined in claim 3, wherein the first control means controls speed of revolution of the driving motor by converting the time when the driving motor is turned on and turned off.

5. A sheet transporting apparatus as defined in claim 4, wherein the first control means turns off the driving motor when the transporting speed is higher than a predetermined value and turns on the driving motor when the transporting speed is lower than a predetermined value.

6. A sheet transporting apparatus as defined in claim 5, wherein the memory means stores the time when the driving motor is turned on and turned off.

7. A sheet transporting apparatus as defined in claim 1, further comprising a fourth control means for controlling the second transporting means to lower the speed under a predetermined speed when the speed of the second transporting means exceeded a predetermined speed under the control of the second control means.

8. A sheet transporting apparatus, comprising:

a first transporting means;

a second transporting means for receiving sheets transported by the first transporting means and conveying the sheets to the same direction;

a speed detecting means for detecting a transporting speed of the second transporting means;

a first control means for controlling a transporting speed of the second transporting means according to said speed detecting means;

a memory means for storing data to be used for controlling a transporting speed of the second transporting means;

a second control means for controlling a transporting speed of the second transporting means basing on the data stored in the memory means irrespective of said speed detecting means; and a third control means for selecting either one of the first control means or the second control means corresponding to a condition under which sheets are being transported.

9. A sheet transporting apparatus, comprising:

a sheet transporting means;

a detecting means for detecting a transporting speed of the sheet transporting means;

a first control means for controlling a transporting speed of the sheet transporting means according to said detecting means;

a memory means for storing the contents of the first control means;

a second control means for controlling a transporting speed of the sheet transporting means according to the contents stored in the memory means; and a changeover means for actuating either one of the first control means or the second control means.

* * * * *